US009315359B2

(12) United States Patent
Roesch et al.

(10) Patent No.: US 9,315,359 B2
(45) Date of Patent: Apr. 19, 2016

(54) CORE FORMING SUPPORT OF A PAPER REEL

(75) Inventors: Frederic Roesch, Colmar (FR); Nicolas Weisang, Colmar (FR); Remy Ruppel, Durrenentzen (FR); Pierre Probst, Ammerschwihr (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 656 days.

(21) Appl. No.: 13/139,082

(22) PCT Filed: Dec. 10, 2009

(86) PCT No.: PCT/EP2009/066820

§ 371 (c)(1),
(2), (4) Date: Aug. 4, 2011

(87) PCT Pub. No.: WO2010/066834

PCT Pub. Date: Jun. 17, 2010

(65) Prior Publication Data

US 2011/0278388 A1 Nov. 17, 2011

(30) Foreign Application Priority Data

Dec. 12, 2008 (FR) ..... 08 58553

(51) Int. Cl.
*B65H 75/10* (2006.01)

(52) U.S. Cl.
CPC ..... *B65H 75/10* (2013.01); *B65H 2701/5112* (2013.01); *B65H 2701/53* (2013.01)

(58) Field of Classification Search
USPC ..... 242/610, 610.1, 610.4; 428/34.2, 428/355 CP
See application file for complete search history.

(56) References Cited

U.S. PATENT DOCUMENTS

| | | | | | |
|---|---|---|---|---|---|
| 1,126,710 | A | * | 2/1915 | Conry | 242/609.4 |
| 1,761,111 | A | * | 6/1930 | Doty | 106/160.1 |
| 5,071,623 | A | * | 12/1991 | Akutsu | 422/420 |
| 5,514,429 | A | * | 5/1996 | Kamihgaraguchi et al. | 428/34.2 |

(Continued)

FOREIGN PATENT DOCUMENTS

| | | | |
|---|---|---|---|
| FR | 2917396 | A1 | 12/2008 |
| GB | 2401870 | A | 11/2004 |

(Continued)

OTHER PUBLICATIONS

PCT International Search Report for International Application No. PCT/EP2009/066820; International Filing Date: Dec. 10, 2009; 3 pgs.

(Continued)

*Primary Examiner* — Emmanuel M Marcelo
*Assistant Examiner* — Justin Stefanon
(74) *Attorney, Agent, or Firm* — Drinker Biddle & Reath LLP

(57) ABSTRACT

A core intended to support a reel of paper, particularly toilet paper, is formed by winding at least one web of cellulose wadding. The core is formed by winding at least one web of cellulose wadding having at least 0.51 g of water-soluble material per gram of cellulose wadding, the water-soluble material being designed to make the web of cellulose wadding more rigid and easier to disintegrate. Thus configured, the core that has both mechanical strength fit for the intended purpose and is far easier to disintegrate than a core made of cardboard such that it can be disposed of directly in a toilet bowl without the risk of blocking the waste pipe.

6 Claims, 1 Drawing Sheet

(56) References Cited

U.S. PATENT DOCUMENTS

| | | | | |
|---|---|---|---|---|
| 5,578,023 | A * | 11/1996 | Schneider | 604/332 |
| 5,865,396 | A * | 2/1999 | Ogg et al. | 242/610.1 |
| 6,036,139 | A * | 3/2000 | Ogg | 242/610.1 |
| 7,951,440 | B2 | 5/2011 | Butler, III | |
| 8,075,699 | B2 * | 12/2011 | Butler, III | 134/22.1 |
| 2005/0069665 | A1 * | 3/2005 | Butler, III | 428/36.9 |
| 2007/0048474 | A1 * | 3/2007 | Butler et al. | 428/36.9 |
| 2009/0075001 | A1 | 3/2009 | O'Neill | |

FOREIGN PATENT DOCUMENTS

| | | | | |
|---|---|---|---|---|
| JP | 9118478 A | 5/1997 | | |
| WO | WO 0247998 A1 * | 6/2002 | | B65D 65/46 |
| WO | 2007030749 A1 | 3/2007 | | |
| WO | WO 2007/133576 | 11/2007 | | |

OTHER PUBLICATIONS

PCT Written Opinion for International Application No. PCT/EP2009/066820; International Filing Date: Dec. 10, 2009; 6 pgs.

* cited by examiner

CORE FORMING SUPPORT OF A PAPER REEL

BACKGROUND OF THE INVENTION

The invention relates to a core suitable as a support for a reel of paper, in particular of toilet paper.

In the field of paper intended for household use, in particular toilet paper and household roll towels, their presentation in the form of rolls or reels is known. The rolls are formed by winding the paper around a core, generally made from cardboard.

The choice of the cardboard actually results from a compromise sought by the manufacturers between the adaptation of the material to the mechanical stresses of manufacture and the desire to limit the cost of the end product. Specifically, it happens that these cores are subjected during manufacture of the rolls to various mechanical stresses, whether during the passage through the winder, during the packaging of the rolls in the packets, or during the stacking of the packets of rolls on pallets for transport. The material of these cores must, in particular, have good stiffness properties to withstand the loads and forces to which the rolls are subjected through their production and distribution cycle. A material that lacks sufficient strength would in fact cause deformation of the individual rolls or even collapse of the stacks of rolls on the pallets. Hence this would have a particularly harmful impact on the quality of the products obtained or on the overall production yield of these rolls.

Cardboard is a solution ideally adapted to the requirements. It also has the advantage of being relatively inexpensive.

However, this type of cardboard core cannot be disposed of easily. It would be desirable for it to be disposable in toilet bowls.

The end consumer has for a long time been accustomed to throwing the sheets of toilet paper into the toilet bowl and disposing of them by flushing. This generally causes no obstruction of the pipe, since the cellulose fiber material, also called tissue paper, constituting these sheets, disintegrates easily and rapidly in the presence of water.

However, the same operation is inapplicable for discarding the cardboard core, once the entire paper reserve has been used up. This is because cardboard is a much less absorbent material than tissue paper. It disintegrates very slowly in water and forms a plug in the toilet drain pipe, if the toilet is flushed just after it is thrown therein.

It is therefore desirable for the present invention to solve the problem raised by the prior art and, in particular, to propose a core that disintegrates easily in water.

BRIEF DESCRIPTION OF THE INVENTION

In an embodiment, the invention proposes a core suitable as a support for a reel of paper, in particular of toilet paper, wherein the core is formed by winding at least one band of cellulose fiber, the band having at least 0.51 gram of a water-soluble material per gram of cellulose fiber, the water-soluble material being determined to confer stiffness and disintegrability on the cellulose fiber band.

According to an embodiment of the invention, the cellulose fiber band comprises no more than 1.5 grams of the above-noted material per gram of cellulose fiber.

In an embodiment, the band comprises at least two plies of cellulose fiber joined together by the above-noted water-soluble material and no more than 24 plies, an embodiment particularly having between 3 and 8 plies.

This result is obtained with a water-soluble material comprising starch and optionally a water-based adhesive.

The basis weight of the plies is between 15 and 80 g/m$^2$.

An embodiment of the invention also relates to a method for manufacturing a core as described above, comprising the following steps:

a) supplying a first band of cellulose fiber comprising at least one ply, b) supplying a second band comprising at least one ply, c) depositing a water-soluble material on the first band, the material being in the wet state, d) joining and pressing the first band with the second band, the assembly obtained constituting a third band in which the plies are joined by the water-soluble material, e) drying the third band, f) helically winding the third band on itself or with a fourth band, with the insertion of an adhesive material, in the form of a hollow tube, g) cutting a section of the tube to form the core.

Depending on the desired strength and stiffness, a new band of cellulose fiber is may be joined to the third band to form a new third band, and the operation is repeated until the desired band, in terms of stiffness, is obtained. The third band may therefore comprise 2 to 24 plies.

The fourth band may be identical to the third band or may comprise at least two plies of cellulose fiber joined together by a water-soluble material.

Thus, an embodiment of the invention is considered suitable for supplying a core having mechanical strength suitable for the intended use and significantly improved disintegration compared to a cardboard core, so that it can be discarded directly into a toilet bowl without any risk of plugging the drain pipe.

Advantageously, the core of the invention has a flat compressive strength and an edge compressive strength that are higher than those of a conventional cardboard core.

BRIEF DESCRIPTION OF THE DRAWINGS

Other advantages and features will appear more readily from the description that follows of an example embodiment according to the invention, with reference to the drawings in which.

DETAILED DESCRIPTION OF THE INVENTION

According to an embodiment of the invention, the water-soluble material is based on starch or polyvinyl alcohol.

The starch comprises natural products of plant origin such as wheat, corn, potato or rice starch, tapioca, sorghum and others, consisting of high molecular weight polymers or polyholosides. In the context of the present invention, starch also includes products derived from natural starch, converted by physical treatment, for example heating, physicochemical treatment or biological treatment, for example enzymatic treatment, of the derivative or modified starches such as cationic, anionic, amphoteric, nonionic or cross-linked starches and products resulting from the hydrolysis of starch such as maltodextrins.

The band of cellulose fiber comprises a plurality of plies or layers of cellulose fiber, each ply having a basis weight of about 15 to about 80 g/m$^2$ and preferably about 20 to about 40 g/m$^2$.

Figure 1:
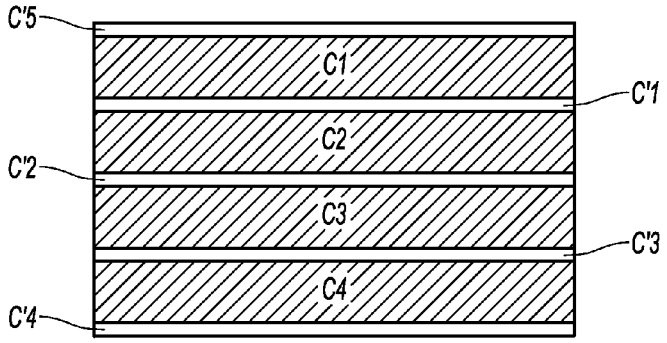
FIG. 1 shows a schematic cross section of a band of cellulose fiber constituting a core in accordance with an embodiment of the invention, and FIG. 2 schematically shows an installation suitable for forming the band of cellulose fiber in FIG. 1.

FIG. 1 schematically shows the structure of an example band of cellulose fiber intended to form the core of the invention.

This structure consists of the stack of 4 plies Cn: C1 to C4, of cellulose fiber joined together by a water-soluble material forming an adhesive in 3 adhesive layers C'n: C'1 to C'3.

Each of the cellulose fiber plies Cn has a basis weight of 34 g/m$^2$.

In this example, each of the water-soluble adhesive layers C'n was formed partly from a mixture of aqueous adhesive based on polyvinyl alcohol and polyethylene glycol such as SWIFT® L998/4 sold by FORBO, and potato starch such as AMYLOGUM CLS® sold by AVEBE, and partly exclusively using potato starch such as AMYLOGUM CLS®.

More generally, for the water-soluble material, in addition to starch, a small quantity, less than 2%, of a water-soluble adhesive is optionally used.

The weight of adhesive and starch in each of the layers C'n is given in the table below for three example quantities of water-soluble material per gram of cellulose fiber: 0.58; 0.91; and 1.13 g/g.

This cylindrical portion is then positioned between the two metal plates of a dynamometer, the plates being parallel to one another and initially separated by a distance slightly greater than the length of the cylindrical portion, in the case of the edge compression measurement, or to its diameter, in the case of the flat compression measurement.

In measuring the edge compressive strength, the cylindrical portion is positioned so that the cylinder axis is perpendicular to the plane formed by one or the other of the plates.

The resistance offered by the core is measured up to its maximum, that is to say just before the core is irreversibly damaged.

In measuring the flat compressive strength, the cylindrical portion is positioned so that the cylinder axis is parallel to the plane formed by one or the other of the plates.

The cylindrical portion is then pressed between the two plates, with measurements for two compression distances: 13 mm/min and 15 mm, at which the force is recorded.

The table shows that the core of the invention had a flat compressive strength greater than that of a similar cardboard core.

| g. Starch/ g. cellulose fiber (4 plies tissue 136 g/m$^2$) | Layer C'1 g/m$^2$ | Layer C'2 g/m$^2$ | Layer C'3 g/m$^2$ | Layer applied on each side of band C'5 and C'4 | Basis weight one band g/m$^2$ | Basis weight Core g/m$^2$ | Core mass (ø40-50 mm) g | Compression measurement (N) flat 13 mm | Compression measurement (N) flat 15 mm | Compression measurement (N) on edge |
|---|---|---|---|---|---|---|---|---|---|---|
| 0.58 (79 g/m$^2$ Starch) | Adhesive: 0 Starch: 0 | Adhesive: 0.75 Starch: 14.2 | Adhesive: 0.75 Starch: 14.4 | Adhesive: 0 Starch: 25.2 | 215 | 445 | 2.78 | 7.9 +/− 0.5 | 8.7 +/− 0.5 | 325 +/− 65 |
| 0.91 (124 g/m$^2$ Starch) | Adhesive: 0 Starch: 0 | Adhesive: 0.75 Starch: 14.2 | Adhesive: 0.75 Starch: 14.4 | Adhesive: 0 Starch: 47.7 | 260 | 520 | 3.27 | 12.7 +/− 0.4 | 13.8 +/− 0.4 | 550 +/− 40 |
| 1.13 (154 g/m$^2$ Starch) | Adhesive: 0 Starch: 0 | Adhesive: 0.75 Starch: 14.2 | Adhesive: 0.75 Starch: 14.4 | Adhesive: 0 Starch: 62.7 | 290 | 590 | 3.72 | 14.7 +/− 1.9 | 15.9 +/− 2.0 | 454 +/− 65 |
| Cardboard core one strand | | | | | 280 | 365 | | 5.17 +/− 0.43 | 5.64 +/− 0.50 | 272.8 +/− 9.6 |

Subsequently, each of the outer sides of this band was coated with a starch solution without added adhesive, of the same type as that used in the adhesive layers C'n to form the layers C'4 and C'5.

The band was then helically wound on a cylinder, using a technique which may be known from the prior art, with another similarly obtained band, to form a core called a two-strand core, each band forming one strand.

The core thus prepared was subjected to a series of tests to evaluate its mechanical strength and its disintegration capacity.

Similar tests were conducted on a commercial cardboard core, having the same thickness and the same length as the core of the invention, and having been formed from a single band having a basis weight of about 280 g/m$^2$.

Compression Test:

The flat and edge compressive strengths of the core are measured using the following method.

The core to be tested is first cut in a cylindrical portion bounded by two opposite faces, perpendicular to the axis of the cylinder, said portion having a length of 50 mm in the direction parallel to the axis.

Since the main stresses applied to the core during its production and distribution cycle are essentially applied flat, the core of the invention can be considered to fully meet the requirements in this respect.

The edge compressive strength of the core of the invention is also greater than that of a similar cardboard core. With regard to storage stresses, the core of the invention is also fully satisfactory.

Disintegration Test:

The disintegration capacity of the core is measured according to standard NF Q34-020 with stirring.

It was found that the core of the invention disintegrated completely at least 5 times faster than a similar cardboard core formed from a single band having a basis weight of 280 g/m$^2$, whether with or without stirring.

It was also observed that the core began to disintegrate in the water at least three times faster than a similar cardboard core obtained by winding a single band of cardboard having a basis weight of 280 g/m$^2$.

In the context of the present invention, similar core means a core having substantially the same diameter and the same length as the core of the invention.

Disposal Test:

A core was placed in a household disposal system formed of a toilet bowl connected to a pipe network having a total length of 18 m.

Using a conventional water flush system discharging into the bowl, a quantity of water was poured in order to discharge the core from the bowl and move it the entire 18 m length of pipe.

The quantity of water required for this disposal was measured both for a core of the invention and for a similar cardboard core formed from a single band having a basis weight of 280 g/m$^2$.

In the case of the core of the invention, about 15 l of water were required to discharge the core from the bowl and through the 18 m of pipe.

In the case of the similar cardboard core, the core did not traverse the entire 18 m of pipe even after having poured more than 50 l of water.

Figure 2:
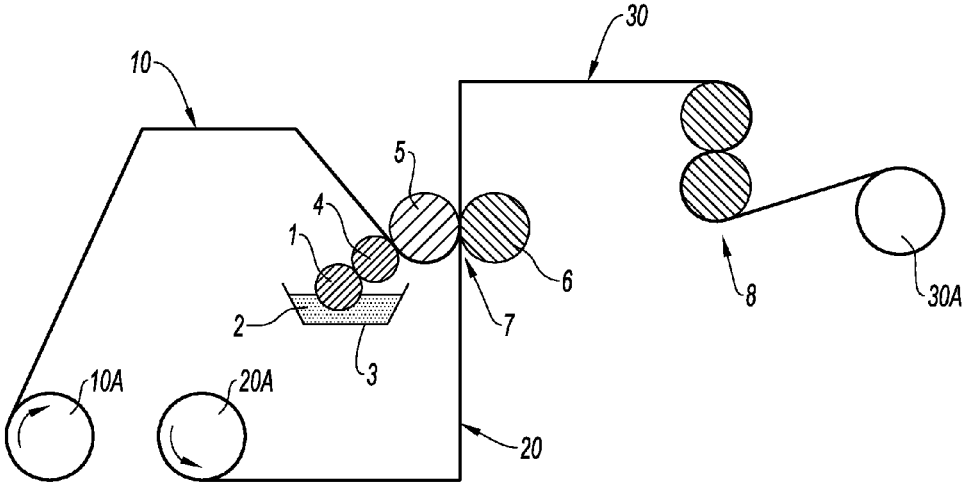

FIG. 2 schematically shows an installation for forming the band of cellulose fiber constituting the core of the invention.

A first band 10 of tissue paper comprising a single ply is fed from a first reel 10A to a sizing station. The station comprises an engraved roller 1 immersed in a size solution 2 based on aqueous adhesive and starch contained in a storage tank 3, the roller 1 subsequently transferring the size solution 2 to an applicator roll 4.

During the passage of the first band 10, the applicator roll 4 is contacted with one of the outer surfaces of the band 10 in order to deposit an adhesive layer on the outer face.

Once the adhesive is applied, the first band 10 is pressed with a second band 20 of one-ply tissue paper fed from a second reel 20A, so that the adhesive layer is imprisoned between the two bands 10 and 20. The pressing station consists of a smooth steel roll 5 and an elastomer roll 6 having a Shore A hardness of about 95, which are separated in order to create a pinching zone 7 through which the assembly of the first and second bands 10 and 20 travels.

This causes the formation of a third band 30 at the discharge end of the pressing station, the third band comprising two outer plies of tissue paper and one inner adhesive layer.

The third band 30 is then hot dried at 140° C. by passage through a calendering station 8 formed of two heated rolls, and finally wound in the form of a third reel 30A.

Depending on the number of plies that the band of tissue paper must finally have, it may optionally be necessary to use this third reel 30A instead of the first 10A and/or second 20A reel, and again to repeat the steps mentioned above. Thus, the above operation can be repeated as often as necessary in order to obtain a band of tissue paper having exactly the desired number of plies.

Subsequently, and using an additional coating station (not shown), each of the outer faces of the band obtained is coated with one or more layers based on starch, thereby giving it improved stiffness.

The band thus starched constitutes the base material used for the formation of the core. This type of core is generally formed by helically winding one or more bands around a shaft. The resulting hollow tube is then cut into sections of equal length, each of the sections forming a core of the invention.

Instead of the method described above, it is also feasible to simultaneously wind a plurality of bands of tissue paper using a winding device comprising as many feed stations as bands to be wound, the number of bands corresponding to the number of layers of cellulose fiber to be incorporated in the core.

Depending on the mechanical strength, especially compressive strength, to be obtained for this core, and its ability to disintegrate more or less easily and rapidly, it is feasible to vary the number of layers of tissue paper used to form each of the bands and the total amount of starch with which each of the bands is impregnated.

In particular, one ideal solution is to use between 2 and 24 layers of tissue paper, and more specifically between 3 and 8 layers of tissue paper.

Furthermore, the band is impregnated with starch-based water-soluble material in a concentration of at least 0.51 g of starch per gram of cellulose fiber.

The invention claimed is:

1. A core suitable as a support for a reel of paper, comprising:

a helically wound band comprising at least one alternation of one ply of cellulose fiber in direct contact with a separate non-fibrous layer of water soluble material, wherein each alternation contains at least 0.51 to no more than 1.5 grams of water-soluble material comprised in the separate non-fibrous layer of water soluble material per gram of ply of cellulose fiber.

2. The core as claimed in claim 1, wherein the helically wound band comprises between 1 and 12 alternations.

3. The core as claimed in claim 2, wherein the plies have a basis weight of between 15 and 80 g/m$^2$.

4. The core as claimed in claim 2, wherein the helically wound band comprises between 1.5 and 4 alternations.

5. The core as claimed in claim 1, wherein the water-soluble material comprises at least one of starch or polyvinyl alcohol.

6. The core as claimed in claim 5, wherein the water-soluble material also comprises a water-based adhesive.

* * * * *